US006006663A

United States Patent [19]

Kropp et al.

[11] Patent Number: 6,006,663

[45] Date of Patent: Dec. 28, 1999

[54] PRINTING PRESS AND METHOD HAVING A PRINTING UNIT CYLINDER PROTECTED AGAINST CORROSION

[75] Inventors: Frank Kropp, Neckarsteinach; Joachim Sonnenschein, Mühltal, both of Germany

[73] Assignee: Heidelberger Druckmaschinen Aktiengesellschaft, Heidelberg, Germany

[21] Appl. No.: 09/023,956

[22] Filed: Feb. 17, 1998

[30] Foreign Application Priority Data

Feb. 14, 1997 [DE] Germany ..... 197 05 671

[51] Int. Cl.[6] ..... B41F 5/00; B05D 1/02

[52] U.S. Cl. ..... 101/216; 29/895.32; 492/56

[58] Field of Search ..... 427/425; 492/18, 492/30, 37, 53, 56, 57, 59; 29/895.3, 895.32; 101/216, 375, 487, 401.1

[56] References Cited

U.S. PATENT DOCUMENTS

| | | | |
|---|---|---|---|
| 1,404,209 | 1/1922 | Linder et al. . | |
| 2,927,346 | 3/1960 | Hill | 492/59 |
| 3,009,209 | 11/1961 | Weinbrenner et al. | 427/425 |
| 3,133,340 | 5/1964 | Finelli | 492/59 |
| 3,225,419 | 12/1965 | Milton et al. . | |
| 3,599,306 | 8/1971 | Brafford | 492/30 |
| 3,874,903 | 4/1975 | Wirth et al. | 428/416 |
| 4,296,172 | 10/1981 | Hill | 101/375 |
| 4,571,798 | 2/1986 | Adams | 427/425 |
| 4,643,095 | 2/1987 | Pfizenmaier et al. . | |
| 5,176,940 | 1/1993 | Salo et al. | 427/425 |
| 5,387,172 | 2/1995 | Habenicht et al. | 492/56 |
| 5,415,612 | 5/1995 | Carlson et al. | 492/56 |
| 5,553,381 | 9/1996 | Lehtonen | 29/895.32 |

FOREIGN PATENT DOCUMENTS

| | | |
|---|---|---|
| 0 583 543 A1 | 2/1994 | European Pat. Off. . |
| 23 28 738 A1 | 1/1975 | Germany . |
| 36 08 286 C2 | 11/1990 | Germany . |
| 6606126 | 11/1966 | Netherlands . |

OTHER PUBLICATIONS

Japanese Patent Abstract No. 61193892 (Shigefumi et al.), dated Aug. 28, 1986.

Japanese Patent Abstract No. 4–238034 (Kawakami), dated Aug. 26, 1992.

*Primary Examiner*—Edgar Burr
*Assistant Examiner*—Leslie J. Grohusky
*Attorney, Agent, or Firm*—Herbert L. Lerner; Laurence A. Greenberg

[57] ABSTRACT

A method for applying an anti-corrosion protective layer to the surface of a cylinder for the printing unit of a printing press, the surface having been cleaned and microroughened, includes uniformly applying to the cylinder surface a thermally cross-linkable plastic material dissolved in a solvent, drying and, respectively curing and cross-linking the plastic material layer at an elevated temperature, and then mounting the cylinder in the printing unit without further processing the surface form; and a printing unit cylinder having a surface to which the anti-corrosion layer has been applied.

12 Claims, 2 Drawing Sheets

PRINTING PRESS AND METHOD HAVING A PRINTING UNIT CYLINDER PROTECTED AGAINST CORROSION

BACKGROUND OF THE INVENTION

Field of the Invention

The invention relates to a printing unit cylinder protected against corrosion, i.e., a corrosion-proof printing unit cylinder, and a method of protecting the printing unit cylinder against corrosion.

Printing unit cylinders installed in modern printing presses, especially rubber blanket cylinders and plate cylinders of web or sheet-fed rotary offset printing presses, are typically coated with protective layers in order to prevent corrosion of the cylinder surface. Simple anti-corrosion layers for gray cast iron or steel cylinders are created by phosphating and subsequent oiling of the cylinder jacket face. It has also become known to create high-quality anti-corrosion layers for printing unit cylinders by electroplating with zinc, nickel and chromium, as described in U.S. Pat. No. 4,643,095, for example, or to melt onto the plate cylinder, with the aid of a laser (German Patent 36 08 286), similarly thin metal layers of chromium, nickel, and so forth. Other metal layers, such as high-quality or stainless steel, are applied to the printing cylinder by plasma coating in an argon atmosphere, for example as taught by the published Japanese Patent Document JP 4-238034.

Besides the fact that these conventional methods are relatively complicated and consequently expensive, they often also require post-machining or after-treatment of the cylinder jacket face in order to ensure that dimensional deviations in the cylinder formed after the coating process remain within a tolerance, typically 5 $\mu$m, prescribed for the cylinders.

From both the published non-prosecuted European Patent Application EP 0 583 543 A1 and U.S. Pat. No. 4,643,095, it has also become known to provide the impression cylinder, and not the plate cylinder or rubber blanket cylinder, in the printing unit of a rotary printing press with a layer which, however, is a relatively thick, namely from 0.4 to 1 mm thick, layer of plastic material formed of polyurethane.

The intent in the foregoing references, however, is not to protect the impression cylinder against corrosion but rather to utilize the resilient and elastic properties, respectively, of such a layer in the direct printing process described therein in order to optimize the printing or reproduction performance.

In the published non-prosecuted Japanese Patent Application JP-61-79697, a dampening roller for the dampening unit of an offset printing press is described which carries a hydrophilic layer formed of a mixture of polyurethane and quartz powder and having a thickness of between 50 $\mu$m and 150 $\mu$m. Besides the fact that neither a printing cylinder nor an anti-corrosion layer is involved in this publication, the surface of the dampening roller described therein is also ground after it has been coated.

Generally, conventional coatings of such plastic materials as polyamides (for example, known under the trade name Rilsan) applied to rollers in the inking or dampening unit of printing presses are not especially well suited as anti-corrosion layers, because these layers adhere rather poorly to the surface of the cylinders and are therefore shrunken relatively thickly onto the cylinder surface so that post-machining or after-treatment of the cylinder surface is then required. Such a shrinkage package is moreover possible only for completely closed cylinder surfaces.

SUMMARY OF THE INVENTION

It is accordingly an object of the invention to provide a method of applying an anti-corrosion layer to the surface of cylinders in a printing unit of a printing press which is as simple and economical as possible, and to provide a printing press with printing unit cylinders which are protected against corrosion in this manner.

With the foregoing and other objects in view, there is provided, in accordance with one aspect of the invention, a method for applying an anti-corrosion protective layer to the surface of a cylinder for the printing unit of a printing press, the surface having been cleaned and microroughened, comprises uniformly applying to the cylinder surface a thermally cross-linkable plastic material dissolved in a solvent; drying and, respectively curing and cross-linking the plastic material layer at an elevated temperature; and then mounting the cylinder in the printing unit without further processing the surface form.

In accordance with another mode, the method of the invention includes applying the dissolved plastic material to the cylinder at an elevated temperature.

In accordance with a further mode, the method of the invention includes bringing the cylinder to a temperature between 40° C. and 80° C., and applying the dissolved plastic material within a temperature range between 40° C. and 80° C.

In accordance with an added mode, the method of the invention includes performing the cross-linking of the plastic material at a temperature above 120° C.

In accordance with an additional mode, the method of the invention includes spraying the dissolved plastic material onto the cylinder surface.

In accordance with yet another mode, the method of the invention includes applying an adhesive primer to the surface of the cylinder before the plastic material is applied.

In accordance with yet a further mode, the method of the invention includes phosphating the surface of the cylinder before the plastic material is applied.

In accordance with yet an added mode of the method of the invention, the plastic material contains one or a mixture of more than one substances of the group consisting of polyurethane, phenolic resin, epoxy resin, polyester resin, silicone resin, acrylic resin, acrylates, and nitrile butadiene.

In accordance with another aspect of the invention, there is provided, in a printing press, a printing unit cylinder having an outer cylindrical surface provided with an anti-corrosion protective layer at most 100 $\mu$m thick, the anti-corrosion layer comprising wearproof and abrasion-proof, thermally cross-linkable plastic material applied to the surface in a firmly adhering manner, the layer having a thickness variable to an extent which is at most 20% thereof or 5 $\mu$m, whichever is greater.

In accordance with a further feature of the invention, the protective layer is applicable in a thickness of up to 50 $\mu$m, with a thickness tolerance of 5 $\mu$m.

In accordance with a concomitant feature of the invention, the printing unit cylinder is the plate cylinder or rubber blanket cylinder of an offset printing press.

Thus, according to the invention, this anti-corrosion protective layer is formed by applying uniformly thinly onto the surface of the printing unit cylinder, which has been turned, blasted, and so forth, to provide a clean, micro-rough surface, thermally cross-linkable plastic material such as polyurethane, nitrile butadiene, phenolic or epoxy resin, silicone resin, acrylic resin or acrylate, which is dissolved in a solvent or dispersed in a dispersing medium; the cylinder is thereafter dried and then cured and cross-linked at elevated temperature, so that an abrasion-proof protective layer at most 100 μm thick is formed and bonds adhesively to the cylinder surface. The cylinder provided with this layer is then mounted without further machining of the surface form and installed in the printing press. Because very uniform layers can be produced, for example, by spraying the plastic material onto the cylinder surface, the dimensional deviations of the cylinder surface after the coating has been applied remain within the required tolerance range of typically 5 μm, so that ensuing post-machining or after-treatment can be omitted.

Other features which are considered as characteristic for the invention are set forth in the appended claims.

Although the invention is illustrated and described herein as embodied in a printing press with a printing unit cylinder protected against corrosion, and a method of protecting the printing unit cylinder against corrosion, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
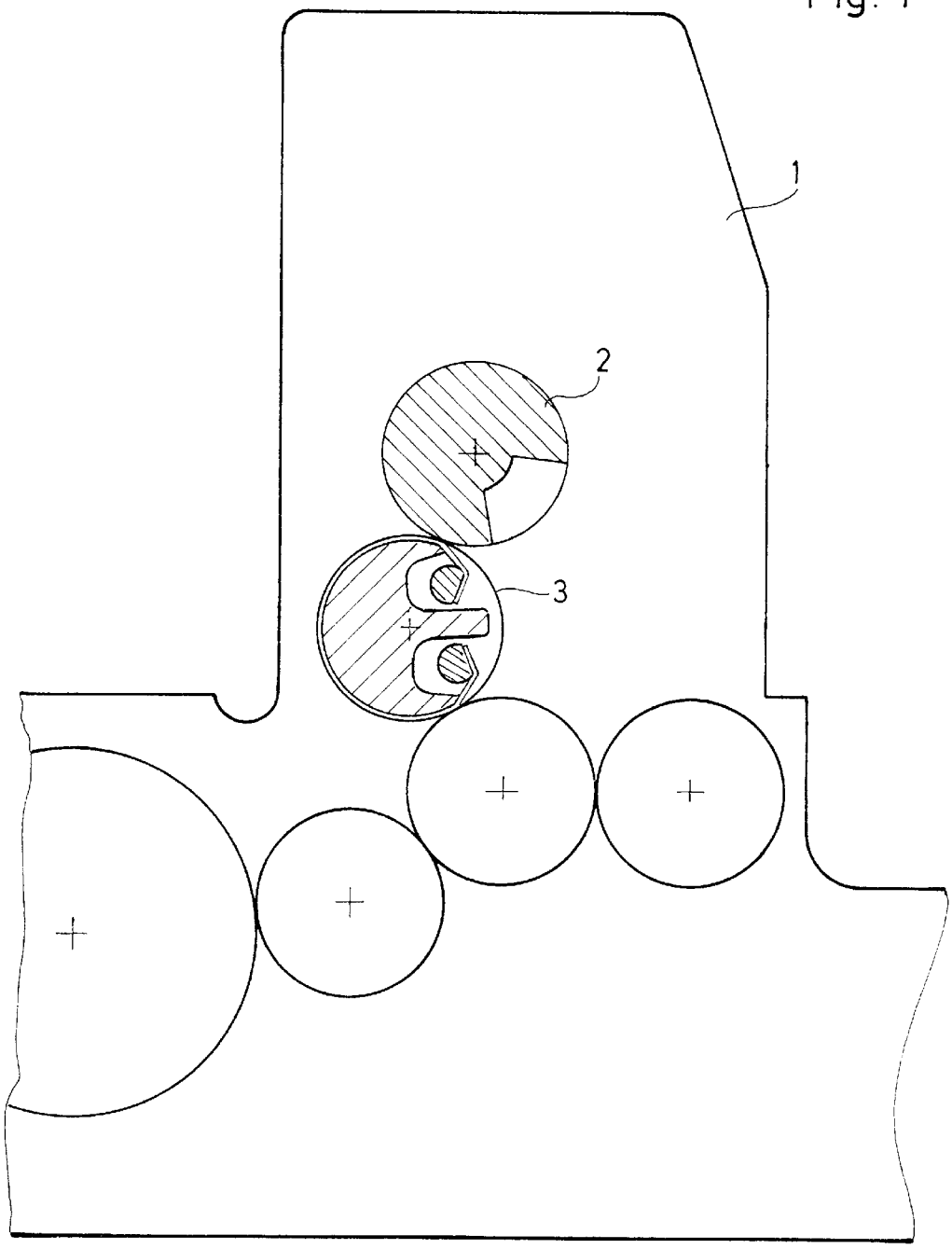
FIG. 1 is a highly diagrammatic side elevational view of a printing unit of an offset printing press, with a plate cylinder and rubber blanket cylinder thereof shown in section.
Figure 2:
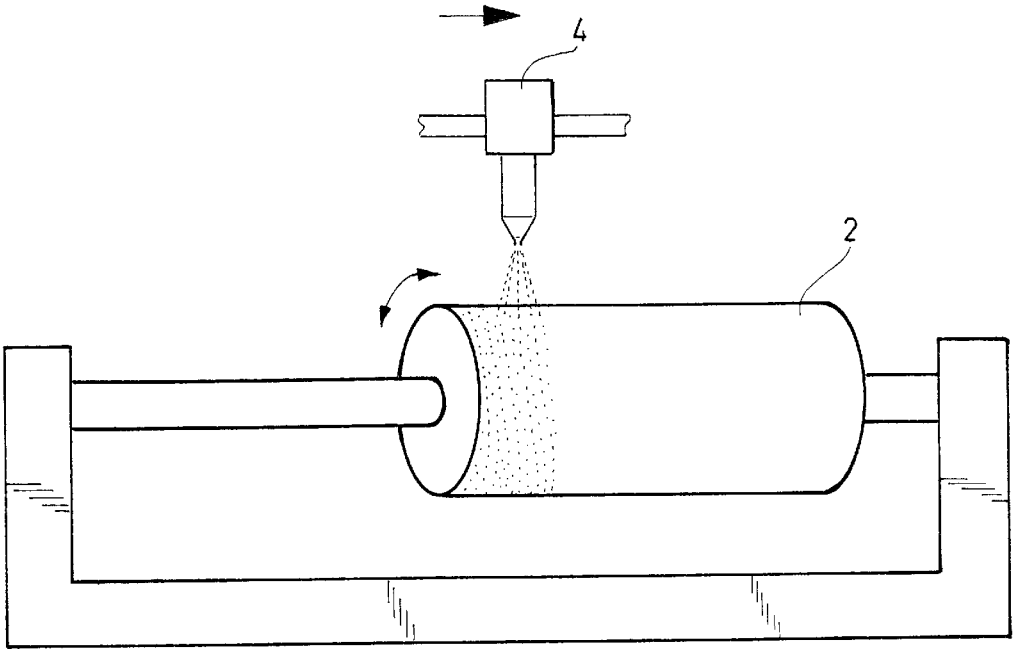
FIG. 2 is a greatly simplified diagrammatic view of equipment for performing the method of coating one of the cylinders of FIG. 1 so as to protect the surface thereof against corrosion in accordance with the invention.

Referring now to the drawings and, first, particularly to FIG. 1 thereof, there is shown therein a printing unit 1 of a printing press including cylinders 2 and 3, more specifically, a plate cylinder 2 and a rubber blanket cylinder 3, which are formed of gray cast iron or steel and, with regard to the shape of the outer cylindrical surface thereof, have been brought very precisely to a diameter with a concentricity accuracy of 0.01 mm. Before being installed in the printing press, the outer cylindrical surface of the respective cylinders 2 and 3 was provided with an anti-corrosion or corrosion protection layer in the following manner:

Initially, the surface was cleaned and roughened by sandblasting, using sand having a defined particle size which produces a peak-to-valley depth of approximately 5 μm. Next, onto the thus-prepared surface, a mixture of primary components, nitrile butadiene (100 parts), phenolic resin (100 parts), carbon black (70 parts), vulcanizing agent (30 parts), zinc oxide (5 parts), stearic acid (one part), accelerator (one part) and hexamethyl tetra-amine (6 parts), dissolved as a 30% solution of a suitable organic solvent, was sprayed at a temperature of approximately 60° C. onto the cylinder which had been heated to approximately 50° C. During the spraying operation, the cylinder 2 was rotated uniformly, and the spray head 4 was passed at constant speed over the outer cylindrical surface thereof, as represented in FIG. 2.

The cylinder spray-coated in this manner was then dried for several hours at the aforementioned temperature, until the layer was free of solvent. Thereafter, the temperature was raised to 130° C. and kept constant for approximately 2 hours, as a result of which the layer polymerized.

In this manner, depending upon the concentration of the dissolved resin and upon the quantity of the mixture which was sprayed on, a desired anti-corrosion layer having a thickness of about 50 μm and adhering very well to the cylinder surface is obtained. Because of how the method is performed, the tolerances of ±2.5 μm for the variation in thickness of the layer are relatively easily adhered to, so that the thus coated cylinder can be mounted and installed in the printing press without further post-machining or after-processing.

With a view to effecting the best possible adhesion of the coating to the cylinder surface, it has proven to be appropriate, before spraying the coating onto the surface, to additionally spray thereon beforehand a primer having as its base a phenolic resin such as polybutiralene, for example, in a very thin layer of approximately 10 μm. As an alternative, the cylinder surface can also be phosphated before being coated with the anti-corrosion protective mixture.

The thus obtained, thoroughly hardened protective layer having a thickness of 50 μm protects the cylinder surface very effectively against corrosion, is resistant to the inks, detergents and solvents used in offset printing, and is relatively impact-proof and abrasion-proof.

As an alternative to the aforedescribed exemplary embodiment, it is also possible, however, that a varnish layer having as its base a dissolved polyurethane compound, can be applied to the cylinder 2 essentially by the same method steps noted hereinbefore. Suitable polyurethane compounds are described, for example, in U.S. Pat. Nos. 5,552,496 and 5,459,197, which are hereby expressly incorporated by reference.

Such a coating, because of the adhesive strength thereof, is also suitable for other sheet-guiding printing unit cylinders, such as, transfer drums, for example, which do not have a fully closed cylinder jacket face, but instead, are formed with cylinder gaps or recesses.

We claim:

1. A method for applying an anti-corrosion protective layer to the surface of a cylinder for a printing unit of a printing press comprising:

cleaning and microroughening a surface of a metal cylinder;

uniformly applying to the surface of the cylinder a thermally cross-linkable plastic material layer dissolved in a solvent so that the layer has a thickness of at most 100 μm;

drying, curing and cross-linking the plastic material layer;

and then without further processing the surface of the cylinder, mounting the cylinder in the printing unit.

2. The method according to claim 1, which includes applying the dissolved plastic material to the cylinder at a temperature of at least 40° C.

3. The method according to claim 2, which includes bringing the cylinder to a temperature between 40° C. and 80° C., and applying the dissolved plastic material within a temperature range between 40° C. and 80° C.

4. The method according to claim 1, which includes performing the cross-linking of the plastic material at a temperature above 120° C.

5. The method according to claim 1, which includes spraying the dissolved plastic material onto the surface of the cylinder.

6. The method according to claim 1, which includes applying an adhesive primer to the surface of the cylinder before the plastic material is applied.

7. The method according to claim 1, which includes phosphating the surface of the cylinder before the plastic material is applied.

8. The method according to claim 1, wherein the plastic material contains one or a mixture of more than one substances of the group consisting of polyurethane, phenolic resin, epoxy resin, polyester resin, silicone resin, acrylic resin, acrylates, and nitrile butadiene.

9. In a printing press, a metal printing unit cylinder having an outer cylindrical surface provided with an anti-corrosion protective layer at most 100 $\mu$m thick, the anti-corrosion layer comprising a thermally cross-linkable plastic material applied to the surface in a firmly adhering manner, the layer having a thickness variable to an extent which is at most 20% thereof or 5 $\mu$m, whichever is greater.

10. The printing unit cylinder according to claim 9, wherein the protective layer is applicable in a thickness of up to 50 $\mu$m, with a thickness tolerance of 5 $\mu$m.

11. The printing press according to claim 9, wherein the printing unit cylinder is a plate cylinder.

12. The printing press according to claim 9, wherein the printing unit cylinder is a rubber blanket cylinder.

* * * * *